US011666938B2

(12) United States Patent
Yun et al.

(10) Patent No.: US 11,666,938 B2
(45) Date of Patent: Jun. 6, 2023

(54) LIQUID PATTERNING DEVICE AND METHOD

(71) Applicant: CURIOSIS Co., Ltd., Seoul (KR)

(72) Inventors: Ho Young Yun, Gyeonggi-do (KR); Myeong Woo Kang, Gyeonggi-do (KR); Noo Li Jeon, Seoul (KR)

(73) Assignee: CURIOSIS Co., Ltd., Seoul (KR)

( * ) Notice: Subject to any disclaimer, the term of this patent is extended or adjusted under 35 U.S.C. 154(b) by 90 days.

(21) Appl. No.: 17/204,969

(22) Filed: Mar. 18, 2021

(65) Prior Publication Data

US 2021/0229127 A1 Jul. 29, 2021

Related U.S. Application Data

(62) Division of application No. 15/306,523, filed as application No. PCT/KR2016/008456 on Aug. 1, 2016, now abandoned.

(51) Int. Cl.

| | |
|---|---|
| ***B05D 1/02*** | (2006.01) |
| ***B01L 3/00*** | (2006.01) |
| ***B05B 1/14*** | (2006.01) |

(52) U.S. Cl.

CPC ..... *B05D 1/02* (2013.01); *B01L 3/502746* (2013.01); *B01L 3/56* (2013.01); *B05B 1/14* (2013.01); *B01L 2300/0851* (2013.01); *B01L 2400/0403* (2013.01); *B01L 2400/086* (2013.01)

(58) Field of Classification Search

CPC ..... B05D 1/02

See application file for complete search history.

(56) References Cited

U.S. PATENT DOCUMENTS

| | | | | |
|---|---|---|---|---|
| 5,106,478 | A | 4/1992 | Musow et al. | |
| 2004/0191127 | A1* | 9/2004 | Kornblit ..... | B01F 33/3031 422/400 |
| 2005/0035983 | A1* | 2/2005 | Cruchon-Dupeyrat ..... | G03F 7/0002 346/140.1 |
| 2005/0042766 | A1 | 2/2005 | Ohman et al. | |

(Continued)

FOREIGN PATENT DOCUMENTS

| | | |
|---|---|---|
| JP | 2007-038134 | 2/2007 |
| JP | 2010-135668 | 6/2010 |

(Continued)

OTHER PUBLICATIONS

M.Kang, et al. Capillarity Guided Patterning of Microliquids on Large Surface. Oct. 25, 2015. The 19th International Conference on Miniaturized Systems for Chemistry and Life Sciences, Gyeongju, Korea. Multiscale Biodmedical Engineering Laboratory. (Year: 2015).*

(Continued)

*Primary Examiner* — Dah-Wei D. Yuan
*Assistant Examiner* — Kristen A Dagenais-Englehart

(57) ABSTRACT

Disclosed is a liquid patterning device and liquid patterning method. The liquid patterning device includes: a substrate having a flat bottom and a surface; at least one microstructure formed to vertically protrude from the surface of the substrate and including a plurality of unit microposts so as to have a desired shape; and a liquid mover for moving a liquid to be patterned on the surface of the substrate in another direction from one direction of the microstructure.

20 Claims, 17 Drawing Sheets

(56) References Cited

U.S. PATENT DOCUMENTS

| | | | |
|---|---|---|---|
| 2007/0059489 | A1 | 3/2007 | Hodes et al. |
| 2013/0032316 | A1 | 2/2013 | Dhiman et al. |
| 2018/0029070 | A1 | 2/2018 | Yun et al. |

FOREIGN PATENT DOCUMENTS

| | | |
|---|---|---|
| JP | 2010-197821 | 9/2010 |
| KR | 10-2005-0031928 | 4/2005 |
| KR | 10-2007-0071011 | 7/2007 |
| KR | 10-2010-0050867 | 5/2010 |
| KR | 10-2011-0058098 | 6/2011 |
| KR | 10-2013-0125976 | 11/2013 |
| KR | 10-2015-0081531 | 7/2015 |
| KR | 10-2015-0098150 | 8/2015 |

OTHER PUBLICATIONS

Kang. et al. Capillarity Guided Patterning of Microliquids. Small, 11(23): 2789-2797, 2015 (Year: 2015).*

Kang et al. Cell Confinement in Patterned Nanoliter Droplets in A Microwell Array by Wiping. Journal of Biomedical Materials Research Part A, 93(2): 547-557, May 2010. (Year: 2010).*

Polystyrene Surface. nanoComposix Fortis Life Sciences. https://nanocomposix.com/pages/polystyrene-surface#:~:text=Particles%20coated%20with%20polystyrene%20have,stick%20strongly%20by%20passive%20adsorption. (Year: 2022).*

Tatiana Trantidou et al. Hydrophilic surface modification of PDMS for droplet microfluidics using a simple, quick, and robust method via PVA deposition. Microsystems & Nanoengineering. 3 Article No. 16091 (Year: 2017).*

Advisory Action Before the Filing of An Appeal Brief dated Oct. 17, 2019 From the US Patent and Trademark Office Re. U.S. Appl. No. 15/306,523. (4 pages).

Final Official Action dated Mar. 23, 2020 from the US Patent and Trademark Office Re. U.S. Appl. No. 15/306,523. (17 pages).

International Search Report dated Apr. 25, 2017 From the Korean Intellectual Property Office Re. Application No. PCT/KR2016/008456. (3 Pages).

Official Action dated Jul. 5, 2019 From the US Patent and Trademark Office Re. U.S. Appl. No. 15/306,523. (15 pages).

Official Action dated Dec. 18, 2020 From the US Patent and Trademark Office Re. U.S. Appl. No. 15/306,523. (27 Pages).

Official Action dated Jan. 18, 2019 From the US Patent and Trademark Office Re. U.S. Appl. No. 15/306,523. (17 Pages).

Official Action dated Nov. 27, 2019 From the US Patent and Trademark Office Re. U.S. Appl. No. 15/306,523. (13 pages).

Official Action dated Jul. 8, 2020 from the US Patent and Trademark Office Re. U.S. Appl. No. 15/306,523. (21 pages).

Restriction Official Action dated Aug. 10, 2018 From the US Patent and Trademark Office Re. U.S. Appl. No. 15/306,523. (5 pages).

Kang et al. "Capillarity Guided Patterning of Microliquids on Large Surface", The 19th International Conference on Miniaturized Systems for Chemistry and Life Sciences, Gyeongju, Korea, Oct. 25-29, 2015, Multiscale Biomedical Engineering Laboratory, 4 P., Oct. 25, 2015.

Kang et al. "Capillarity Guided Patterning of Microliquids", Small, 11(23): 2789-2797, 2015.

Kang et al. "Cell Confinement in Patterned Nanoliter Droplets in A Microwell Array by Wiping", Journal of Biomedical Materials Research Part A, 93(2): 547-557, May 2010.

* cited by examiner

LIQUID PATTERNING DEVICE AND METHOD

RELATED APPLICATIONS

This application is a Division of U.S. patent application Ser. No. 15/306,523 filed on Oct. 25, 2016, which is a National Phase of PCT Patent Application No. PCT/KR2016/008456 having International filing date of Aug. 1, 2016. PCT/KR2016/008456 is also related to Korean Patent Application No. 10-2016-0098144, filed on Aug. 1, 2016. The contents of the above applications are all incorporated by reference as if fully set forth herein in their entirety.

BACKGROUND OF THE INVENTION

(a) Field of the Invention

The present invention relates to a liquid patterning device and a liquid patterning method. More particularly, the present invention relates to a non-channel-type liquid patterning device for patterning a liquid at a desired position by a surface tension between a microstructure including a plurality of microposts and a liquid, and a liquid patterning method.

(b) Description of the Related Art

In general, studies based upon a microfluid as an example of a liquid use a smaller volume of agents to provide faster and highly sensitive detection results, so they have various merits compared to conventional laboratory-based analysis processes.

Studies on the microfluid are increasing in use for realization of cell-based studies and other applications.

The microfluid technology may use microfluidics, fluid separation, cell positioning, 3-dimensional complex cell culturing, harmonized flows, and temporal and spatial changes to successfully imitate real organs. Regarding high efficiency screening and organ-on-chip application, a fixed region of interest (ROI) has been an important item for document analysis and cell positioning. The existing schemes include various methods for fixing the region of interest (ROI) including chemical patterning for coating a chemical material on a surface, extracellular matrix (ECM) patterning, use of optical tweezers, drop formation, patterning using an ultraviolet ray curing material, and a method for continuously applying a fluid and confining a cell into a desired microstructure.

However, the disclosed methods may efficiently fix the region of interest (ROI) but require an additional process (e.g., a continuous fluid flow or using a photo-curable material) or equipment (e.g., a photo-irradiation device).

To solve the problem, a channel-type liquid patterning method for patterning liquid at a desired position on a microfluid platform surface by using a microstructure and a surface tension of liquid without an additional process or device has been proposed.

The channel-type liquid patterning method is a new method for quickly patterning a liquid on the microfluid platform, and is developed by using the surface tension and interface dynamics. A microfluid device including a post array with specific geometry is manufactured. After the microfluid device is manufactured, a liquid (mixture) is filled in a microchannel, the liquid (mixture) in the microchannel is suctioned by using a suction pump with a pressure of 60 kPa during the liquid patterning, the liquid (mixture) is captured inside the post array during the suctioning, and the liquid patterned by using this method may be acquired within five seconds without an additional surface treatment or equipment.

However, regarding the conventional channel-type liquid patterning method, liquid is filled in the microchannel, that is, a top portion of the microchannel is not opened, so a surface of the microfluid device must be hydrophilic so as to use a water-based liquid, the patterning is not uniform according to the affinity between the microfluid and the material of the post, an area to be patterned is influenced by the size of the microchannel, and the patterned area is very limited.

Also, regarding the conventional channel-type liquid patterning method, a liquid must be filled in the microchannel and the liquid must be suctioned with a constant pressure by using a suction pump so the patterning becomes complicated by that degree, a long patterning time is required, it is not easy to form liquid patterns with various shapes and sizes, and it is not easy to recover the patterned liquid.

Further, regarding the conventional channel-type liquid patterning method, to pattern at least two kinds of liquid, each liquid must be filled in the microchannel and then must be patterned, so a lot of time is used for the patterning and the patterning is difficult.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a non-channel-type liquid patterning device that is faster and simpler than the existing channel-type patterning method, that has no limits in shapes and sizes of the pattern, and that enables patterning of a small amount of liquid at a desired position and with a desired shape and size.

The present invention has been made in another effort to provide a liquid patterning device for allowing uniform patterning irrespective of affinity between a liquid (particularly a microfluid) and a material of a micropost.

The present invention has been made in another effort to provide a liquid patterning device for realizing relatively wider patterning compared to the existing channel-type patterning device.

The present invention has been made in another effort to provide a liquid patterning device for quickly and simply patterning at least two kinds of liquids by use of a plurality of nozzles.

The present invention has been made in another effort to provide a liquid patterning method for allowing uniform patterning regardless of affinity between a microfluid and a material of a micropost.

An exemplary embodiment of the present invention provides a liquid patterning device including: a substrate having a flat bottom and a surface; at least one microstructure formed to vertically protrude from the surface of the substrate and including a plurality of unit microposts so as to have a desired shape; and a liquid mover for moving a liquid to be patterned on the surface of the substrate in another direction from one direction of the microstructure.

A top portion of the liquid patterning device may be opened.

The unit micropost may be made of a hydrophilic material or a hydrophobic material.

The liquid mover may include a wiper for wiping the liquid on the surface of the substrate over a unit micropost of the microstructure.

The liquid may be patterned while the wiper moves, or the liquid may be patterned when the wiper is fixed and the substrate including a microstructure moves.

The liquid patterning device may include a plurality of nozzles provided on a top portion of the microstructure and spraying a liquid on a surface of the substrate.

The substrate may be made of a hydrophilic material or a hydrophobic material.

The substrate may be made of a material with a contact angle of 0° to 170° between the surface and the liquid to be patterned.

The unit micropost may be generated to have at least one of shapes including a circular cylinder, a square pillar, a cone, and a curve.

A surface of the wiper may be made of a hydrophilic material or a hydrophobic material.

The wiper may be made of a flexible material that may not damage the unit micropost when the wiper contacts the unit micropost protruding on the surface of the substrate.

When the liquid to be patterned is wiped with the wiper, an angle between the wiper and the surface of the substrate may be between 0° and 90°.

A plurality of nozzles may spray a same color of liquid or different colors of liquids.

A plurality of nozzles may spray the same kind of liquid or different kinds of liquids.

A surface of the wiper may be formed flat.

The liquid to be patterned may include any liquid except for a material that may deform a substrate and a microstructure, or may include a mixture of the liquid and a solid matter including cells, DNA, or microbeads.

Another embodiment of the present invention provides a liquid patterning method for patterning a liquid in a microstructure of a device including a substrate having a flat bottom and a surface, and at least one microstructure formed to vertically protrude from the surface of the substrate and including a plurality of unit microposts so as to have a desired shape, including moving a liquid in another direction from one direction of the substrate, using a surface tension between a liquid and a microstructure generated on a top portion and a side portion of the microstructure, and patterning a liquid into the microstructure.

A top portion of the substrate is opened.

The unit micropost may be made of a hydrophilic material or a hydrophobic material.

According to the present exemplary embodiments, uniform patterning that is faster and simpler than the existing channel-type patterning method, that has no limits in shapes and sizes of the pattern, and that operates irrespective of the affinity between the liquid particularly the microfluid and the microstructure material, is possible.

Compared to the existing channel-type patterning method, it is possible to realize relatively wider patterning and to pattern a small amount of liquid at a desired position.

Further, the liquid is patterned at the designated position so the present embodiment is widely applicable to experiments of cell biology and other fields of biology, and the biggest merit thereof is that it is easy to recover the patterned liquid (or cells or materials).

In addition, it is possible to quickly and simply pattern at least two kinds of liquid by use of a plurality of nozzles.

DETAILED DESCRIPTION OF THE EMBODIMENTS

Figure 1:
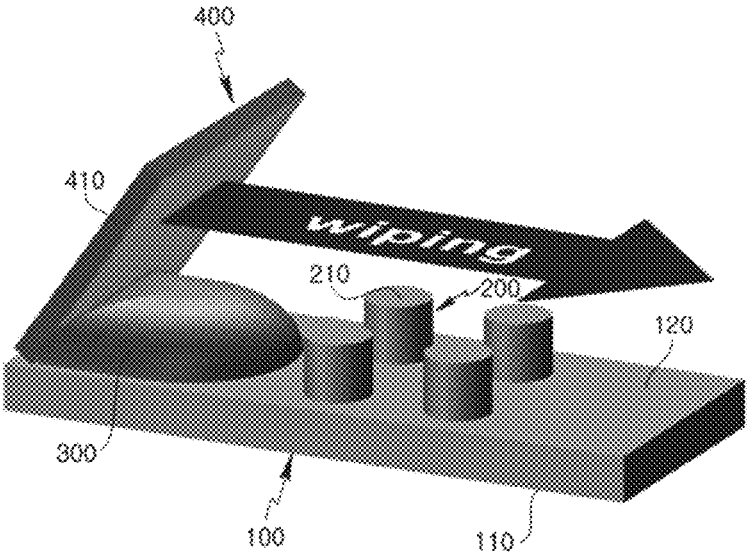
FIG. 1 shows a schematic diagram of a liquid patterning device according to an exemplary embodiment of the present invention.

The present invention will be described more fully hereinafter with reference to the accompanying drawings, in which exemplary embodiments of the invention are shown. It is to be understood that the invention is not limited to the disclosed embodiments, but, on the contrary, is intended to cover various modifications and equivalent arrangements included within the spirit and scope of the appended claims. Whenever possible, the same or similar portions are represented by using the same reference numerals in the drawings.

The terminologies used herein are set forth just to illustrate a specific exemplary embodiment but not to limit the present invention. It must be noted that, as used in the specification and the appended claims, the singular forms include plural reference forms unless the context clearly dictates otherwise. It will be further understood that the terms "comprises" and/or "comprising" when used in this specification, specify the presence of stated properties, regions, integers, steps, operations, elements, and/or components, but do not preclude the presence or addition of one or more other properties, regions, integers, steps, operations, elements, components, and/or groups.

All terms including technical terms and scientific terms used herein have the same meaning as the meaning generally understood by the person with ordinary skill in the art to which the present invention pertains. The terminologies that are defined previously are further understood to have meanings that coincide with relating technical documents and the contents that are currently disclosed, but are not to be interpreted as ideal or very official meanings unless defined as such.

Figure 2:
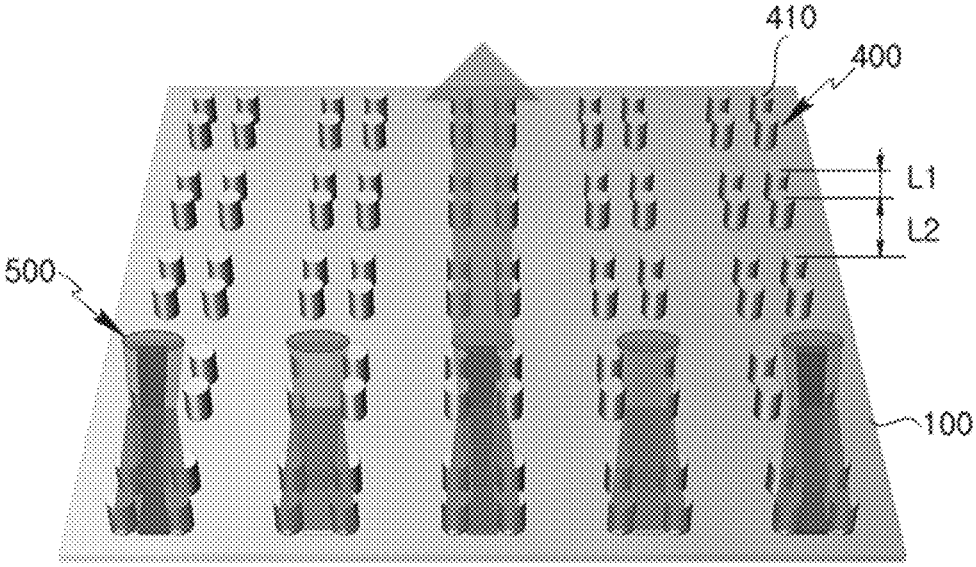
FIG. 2 shows a schematic diagram for applying a nozzle to a liquid patterning device according to an exemplary embodiment of the present invention.

FIG. 1 shows a schematic diagram of a liquid patterning device according to an exemplary embodiment of the present invention, and FIG. 2 shows a schematic diagram for applying a nozzle to a liquid patterning device according to an exemplary embodiment of the present invention.

Referring to FIG. 1 and FIG. 2, the liquid patterning device according to an exemplary embodiment of the present invention represents a device for patterning a liquid at a desired position by a surface tension between a liquid and a microstructure including a plurality of microposts.

The liquid patterning device may include a substrate 100 including a flat bottom 110 and a surface 120, at least one microstructure 200 formed to be vertically protruded on the surface 120 of the substrate 100 and including a plurality of unit microposts 210 having a desired shape, and a liquid mover 400 for moving a liquid 300 to be patterned on the surface 120 of the substrate 100 in another direction from one direction of the microstructure 200.

Regarding the liquid mover 400, any kinds of means for applying a physical force to the liquid applied to the substrate and moving the liquid are usable since they may realize the same effect through the same operation, and they are not limited to a specific means.

For example, the liquid mover 400 may include a wiper for wiping the liquid 300 on the substrate surface over the microposts 210 of the microstructure 200. The wiper will be exemplarily described as a liquid mover in order to describe driving of the liquid patterning device according to an exemplary embodiment of the present invention. For another example, it is possible to use a method for blowing a gas to move a fluid, or a method for allowing a fluid that does not mix with a liquid, such as an oil (in the case of patterning hydrophilic liquid), to flow to move the fluid to be patterned.

A plurality of nozzles 500 provided to the top portion of the microstructure 200 and spraying liquid on the surface 120 of the substrate 100 may be included.

For the purpose of efficiently patterning the liquid 300, a distance L1 between microposts may be provided to be less than a distance L2 between microstructures 200.

A wiper 410 may be directly moved toward the microstructures when the liquid 300 is wiped, and the liquid may be patterned by moving the substrate 100 in the direction of the wiper 410.

An upper portion of the substrate is opened so that liquid may be input through the upper portion, so the material of the substrate 100 may be a hydrophobic material as well as a hydrophilic material.

A material of the substrate 100 may be a polymer such as polystyrene (PS), polycarbonate (PC), polymethylmethacrylate (PMMA), or polyethylene terephthalate (PET), a photocurable material such as SU-8 or PEG-DA, a metal such as aluminum or iron, or a flexible material such as silicon.

For the purpose of efficient patterning of the liquid 300, the substrate 100 may be made of a material with a contact angle between the surface 120 and the liquid 300 to be patterned of 60° to 120°.

The substrate 100 may be made of a plastic material or an elastic material.

The microstructure 200 includes a plurality of unit microposts 210 for generating a desired shape and arranged to generate top, bottom, left, and right meniscuses, and the unit micropost 210 may be formed to be vertically protruded on the surface 120 of the substrate 100.

The unit micropost 210 may be made of a hydrophilic material or a hydrophobic material.

The material of the unit micropost 210 is the same as the material of the substrate, it may become one body with the substrate, and if needed, it may be a different material from the substrate.

The material that is allowable for the substance of the unit micropost 210 corresponds to the material used for the substance of the substrate.

Distances between the microstructures 200 may be provided to be a same distance or different distances.

Distances between the unit microposts may also be provided to be a same distance or different distances.

The unit micropost 210 may be integrally formed with the substrate 100 (i.e., as one body), or it may be individually manufactured and may then be attached to the surface 120 of the substrate 100.

The shape of the unit micropost 210 is not limited to a circular cylinder, so it may be formed to be a square pillar, a cone, or a curve, and it is changeable into various shapes according to its use.

The respective unit microposts 210 configuring the microstructure 200 may be formed to have a same shape, and they may be formed to have different shapes if necessary.

A size and a height of each unit micropost 210 and a distance between unit microposts 210 may be adjustable by a kind of the liquid to be patterned and a patterning speed.

When the unit micropost 210 has a circular cylinder shape, for example, a diameter of the unit micropost 210 is 100 μm-300 μm, a height of the unit micropost 210 is 100 μm-500 μm, a distance between the unit microposts or a distance between the microstructures is 100 μm-500 μm, and the distance between the unit microposts may be less than the distance between the microstructures. This is exemplary and the present embodiment is not restricted thereto.

The type of the liquid 300 to be patterned is not particularly limited, but a liquid with an excessively high surface tension or viscosity may reduce patterning efficiency and uniformity, so intensity of the surface tension and a viscosity degree are modifiable or adjustable by the type of the liquid to be patterned and the patterning speed.

Available materials for the liquid 300 to be patterned include most kinds of liquids except a material such as water, oil, or hydrogel that may deform the substrate and the microstructure, and particularly they include a photoresist such as PEG-DA such as collagen, fibrin gel, or Matrigel, and various other types of materials in a liquid state. A mixture of a liquid and a solid matter such as cells, DNA, or microbeads is usable during the patterning.

The wiper 410 of the liquid mover 400 wipes (or moves) the liquid 300 to be patterned, and a surface of the wiper 410 may be made of a hydrophilic material or a hydrophobic material.

The surface of the wiper 410 may be made flat for the purpose of efficient patterning of the liquid 300.

The wiper 410 of the liquid mover 400 may be made of a flexible material that may not damage the unit micropost when the wiper contacts the unit micropost protruding on the surface of the substrate.

The wiper 410 may be made of a flexible material such as silicon, rubber, a PET film, or a PS film.

When the liquid 300 to be patterned is wiped with the wiper 410, an angle between the wiper and the surface of the substrate may be between 0° and 90°.

The liquid patterning device is applicable to such fields as, for example, cytotoxicity tests for developing new drugs or cosmetics, disease diagnosis, polymerase chain reaction (PCR), or cell biology studies.

A size of each nozzle 500 is adjustable, and for example, it may have a diameter of five to ten inches.

A plurality of nozzles 500 may be formed to have a same size or different sizes.

The nozzles 500 may spray the same color of liquid or liquids of different colors.

The nozzles 500 may spray the same liquid or different kinds of liquids.

Another exemplary embodiment of the present invention provides a method for patterning a liquid into a microstructure of a device including the at least one microstructure including a substrate having a flat bottom and a surface and a plurality of unit microposts vertically protruding on the surface of the substrate and configuring a desired shape, and it provides a liquid patterning method for moving a liquid in another direction from one direction of the substrate, using surface tension between a liquid generated from a top portion and a side of a microstructure and the microstructure, and patterning the liquid into the microstructure.

This may be a liquid patterning method using a device including a substrate and a microstructure on the substrate, excluding the liquid mover from the above-described liquid patterning device.

The liquid patterning method may use a meniscus generated by surface tension between the liquid and the microstructure, the meniscus being generated at a top portion of the microstructure in addition to a lateral side of the microstructure. Hence, the meniscus generated at the lateral side and the meniscus generated at the top portion are summed to pattern the liquid into the microstructure, and the liquid may be patterned regardless of affinity between the liquid and the microstructure.

The top portion of the substrate may be opened. When the top portion is opened, it may be easy to use the meniscus at the top portion of the microstructure, and it may also be easy to recover the same after patterning the liquid.

The unit micropost may be made of a hydrophilic material or a hydrophobic material. This is possible by using the meniscus generated at the top portion, and the unit micropost may be made of a hydrophilic material or a hydrophobic material irrespective of the affinity with the liquid.

An operation of a liquid patterning device according to an exemplary embodiment of the present invention will now be described with reference to FIGS. 1, 2, 3, 4, 5 and 6.

Regarding the liquid patterning device according to an exemplary embodiment of the present invention, when a liquid 300 or hydrogel to be patterned is exemplarily dripped on the surface 120 of the substrate 100 including a plurality of microstructures 200 with the vertically protruding unit microposts 210, the liquid or the hydrogel on the surface 120 of the substrate 100 is wiped in another direction from one direction of the substrate 100 in a like manner of an arrow direction of FIG. 1 by use of the wiper 410 of the liquid mover 400 having a flat surface, the liquid is patterned at the desired position by the surface tension between the liquid 300 or the hydrogel and the unit microposts 210.

As shown in FIGS. 3, 4, 5 and 6, the liquid patterning may be divided into a liquid imbibition phase and a liquid isolation phase.

[Phase 1: Liquid Imbibition]

Figure 3:
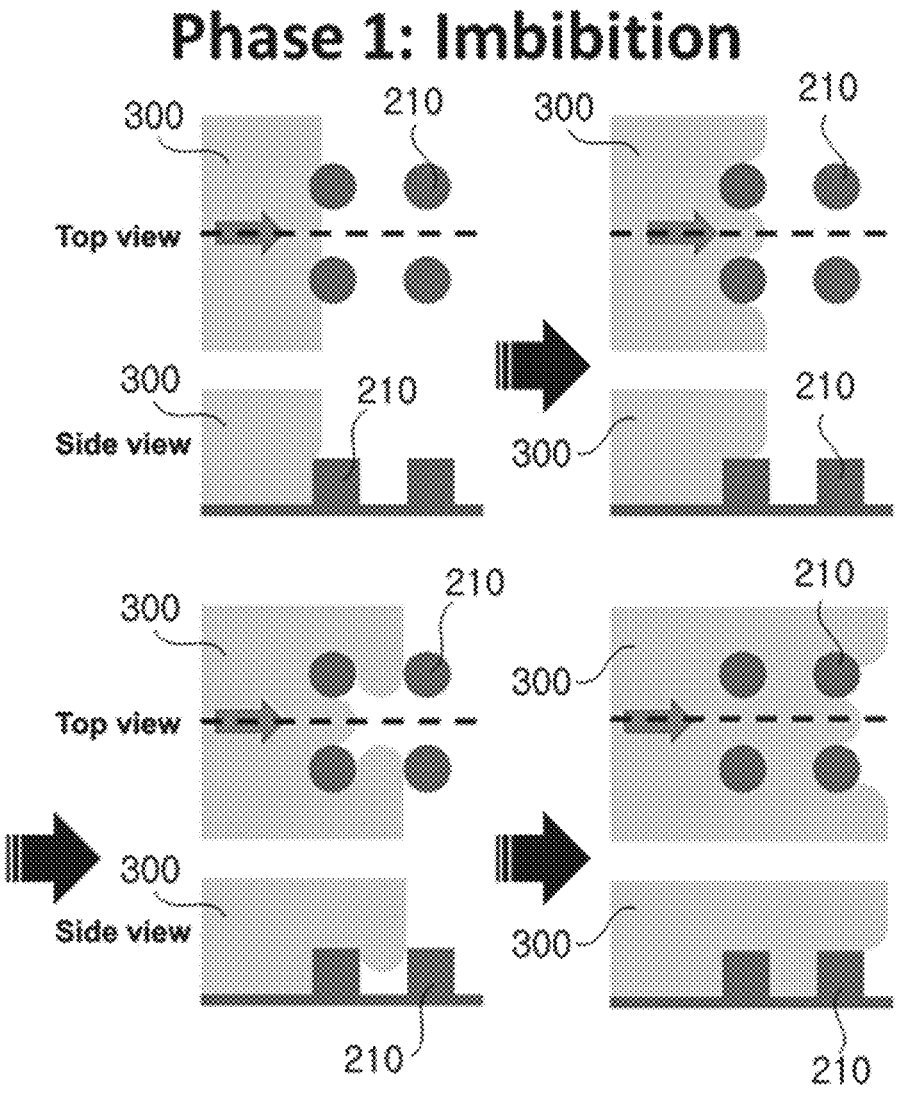
FIG. 3 shows a liquid imbibition process during a liquid patterning process using a liquid patterning device according to an exemplary embodiment of the present invention.
Figure 4:
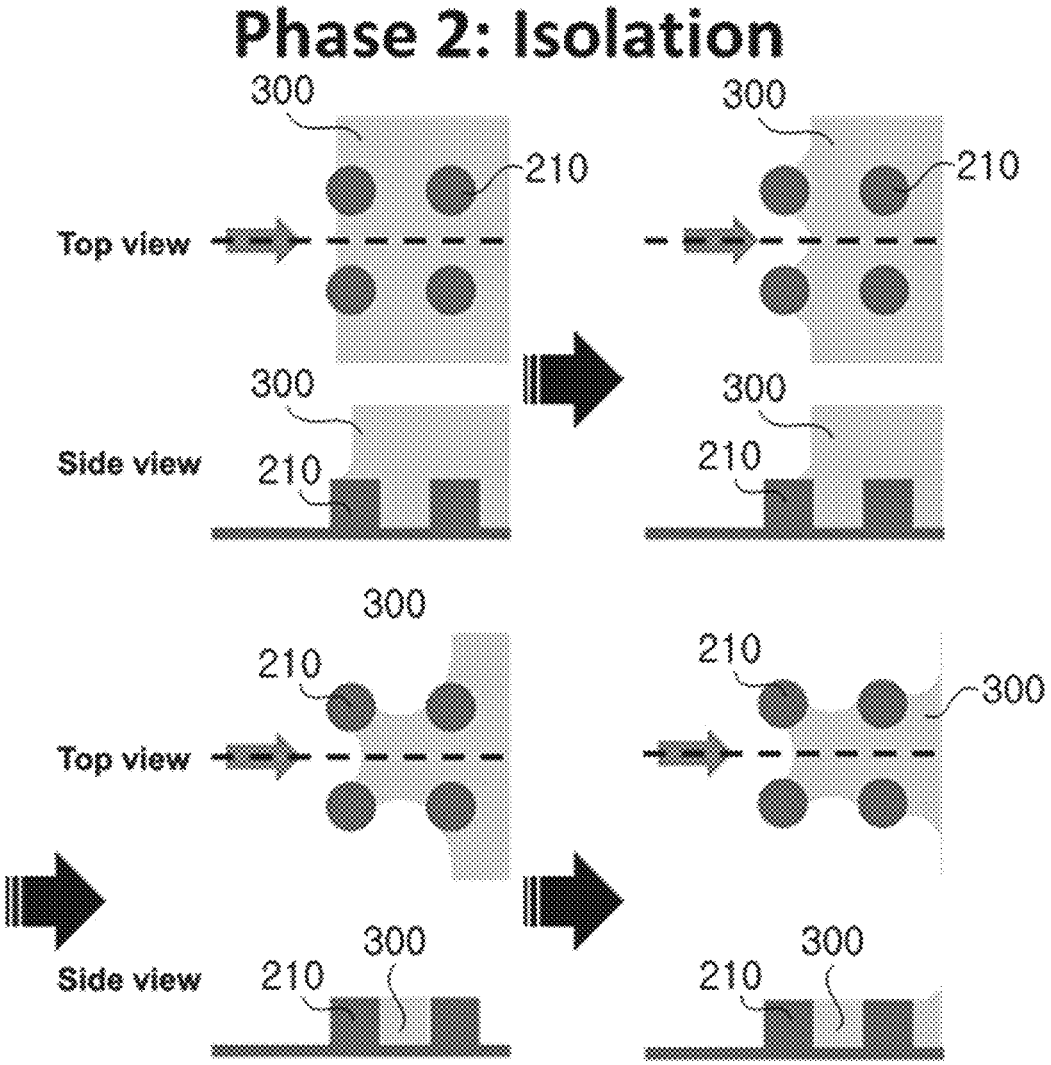
FIG. 4 shows a liquid isolation process during a liquid patterning process using a liquid patterning device according to an exemplary embodiment of the present invention.
Figure 5:
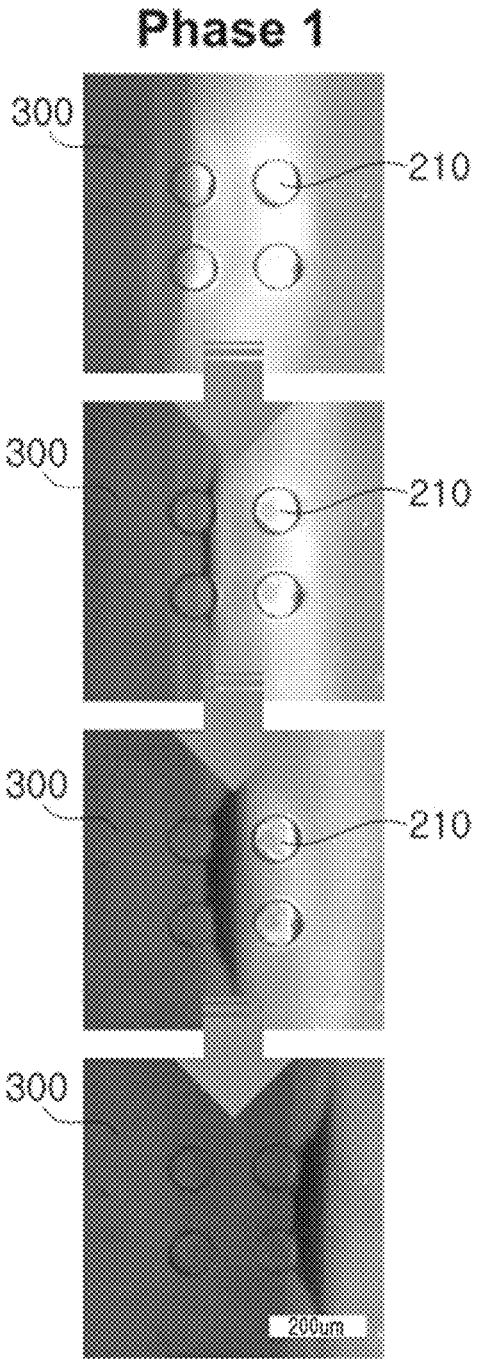
FIG. 5 shows a liquid imbibition process during a liquid patterning process using a liquid patterning device according to an exemplary embodiment of the present invention.
Figure 6:
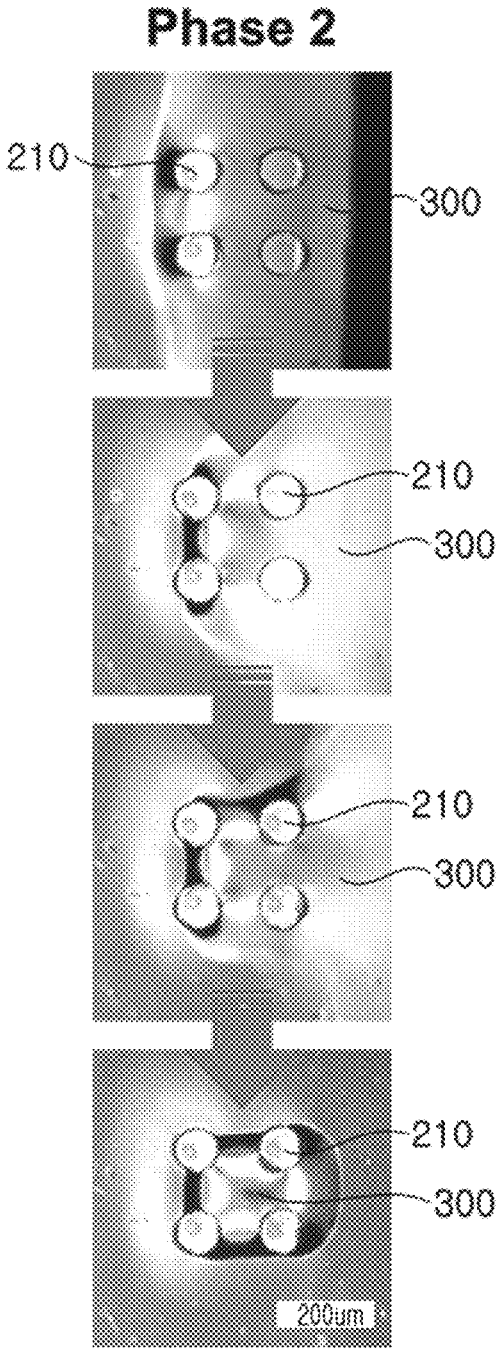
FIG. 6 shows a liquid isolation process during a liquid patterning process using a liquid patterning device according to an exemplary embodiment of the present invention.

When the liquid 300 is wiped, a meniscus is generated between the unit micropost 210 and the liquid 300, and the liquid 300 is provided into the microstructure 200. In this instance, when the substrate 100 is made of a hydrophobic material, as shown in FIG. 3 and FIG. 5, a fluid is not provided into a center portion of the microstructure 200, and three meniscuses on the lateral side are combined by the meniscus coming down from the top of the substrate 100 and the inner part of the microstructure 200 is filled with liquid.

When the substrate 100 and the unit micropost 210 are made of a hydrophilic material, the liquid is well provided therein so there remains no consideration.

[Phase 2: Liquid Isolation]

When the wiping is performed after the liquid 300 is filled inside the microstructure 200, a meniscus is generated and the liquid 300 moves in the wiping direction. In this instance, the meniscus generated between the unit microposts 210 and the external meniscus have a same size of a curvature radius so the meniscus outside the microstructure 200 moves faster and farther and the liquid is resultantly patterned in the microstructure 200.

Further, the liquid patterning device according to a present invention is usable when an influence of the surface tension is greater than an influence of inertia when the liquid moves since the liquid patterning device uses the surface tension of the liquid. Therefore, by using a Weber number showing a relationship between the surface tension and the inertial force, the type of fluid available for patterning, a distance between the unit microposts, and a wiping speed may be calculated and anticipated.

$$We=(\mu Lu^2)/\sigma$$

ρ=density of liquid

σ=surface tension of liquid

L=length between two unit microstructures u=velocity of moving liquid (wiping speed)

Here, the fact that the influence of the surface tension is greater than the influence of inertia signifies that the Weber number is less than 1, so the patterning is allowable under the condition that satisfies $We=(\mu Lu^2)/\sigma\square 1$.

For example, when water is patterned on the microstructures arranged at intervals of 100 um, the following equation must be satisfied.

$$We=(\mu Lu^2)/\sigma=(1000\times 100\times 10^{-6}\times u^2)/0.07\square 1$$

It is found from the calculation that the wiping speed must be slower than about 0.84 m/s when the microstructures 200 arranged at the intervals of 100 um attempt to pattern a liquid, for example, water.

In this way, when the liquid other than water is patterned or in the case of patterning by the microstructures 200 with different intervals or sizes, a result may be predicted, and the liquid patterning device and an automatic patterning system may be designed in consideration of the prediction.

Figure 7:
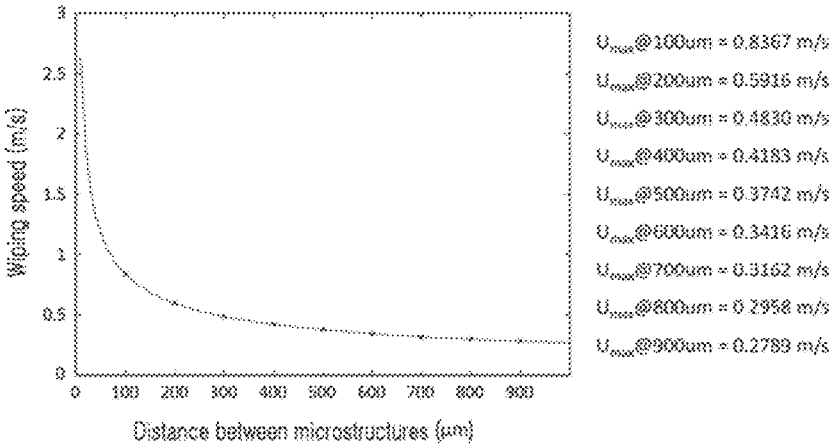
FIG. 7 shows a graph of a relationship of a peak wiping speed with respect to a distance between microstructures in the case of wiping (or patterning) using a liquid patterning device according to an exemplary embodiment of the present invention.

Referring to FIG. 7, as given below, it is found that the wiping must be performed slowly as the distance between the unit microposts becomes greater.

Figure 8:
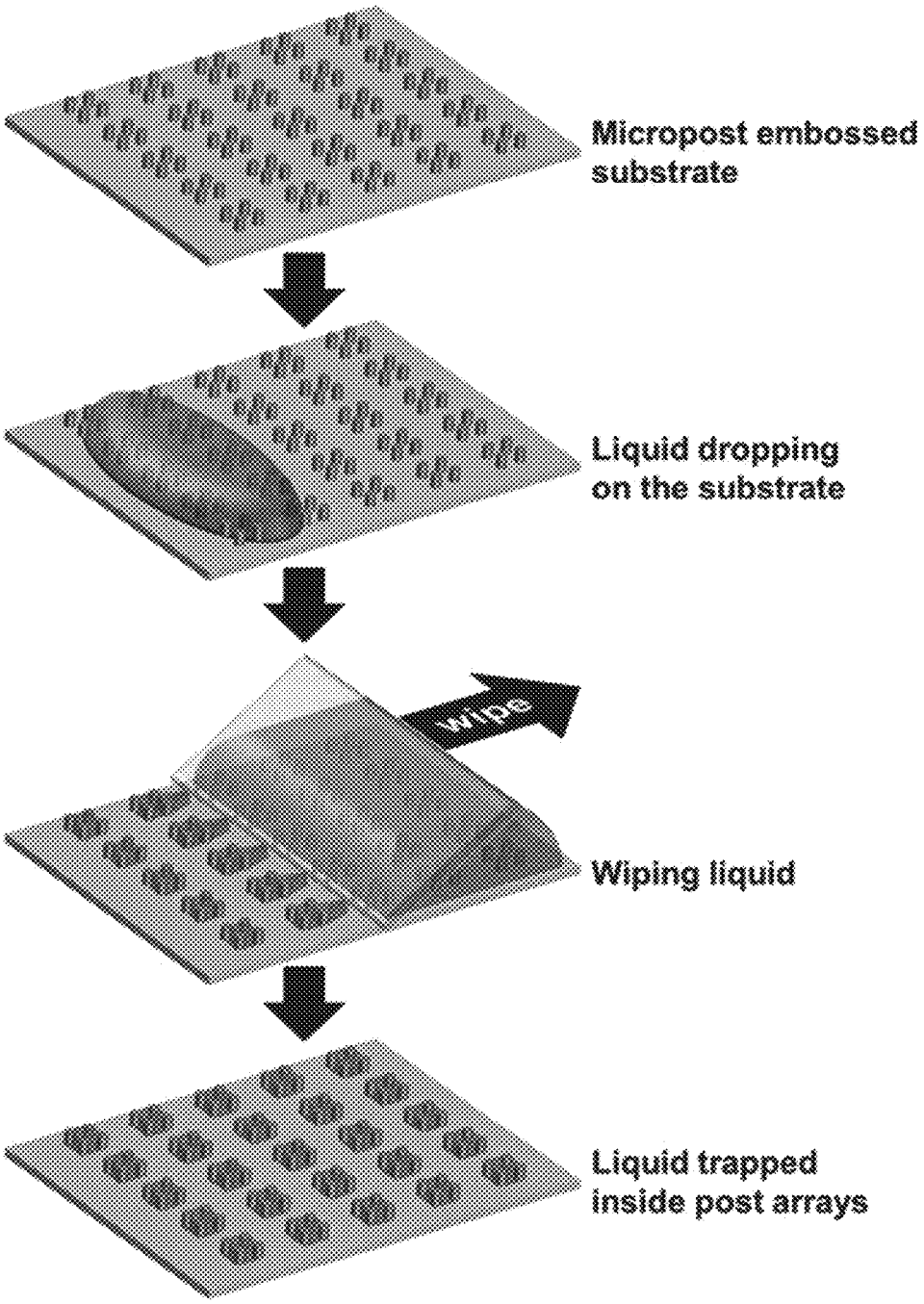
FIG. 8 shows a liquid patterning state by use of a liquid patterning device according to an exemplary embodiment of the present invention.
Figure 9:
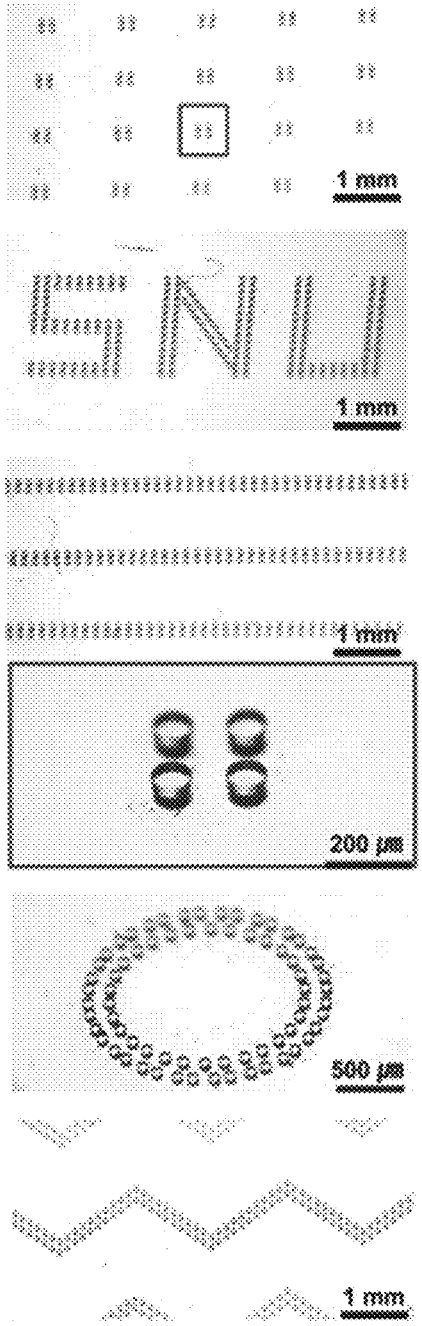
FIG. 9 shows a photograph of microstructures with various patterns and sizes generated by a liquid patterning device according to an exemplary embodiment of the present invention.
Figure 10:
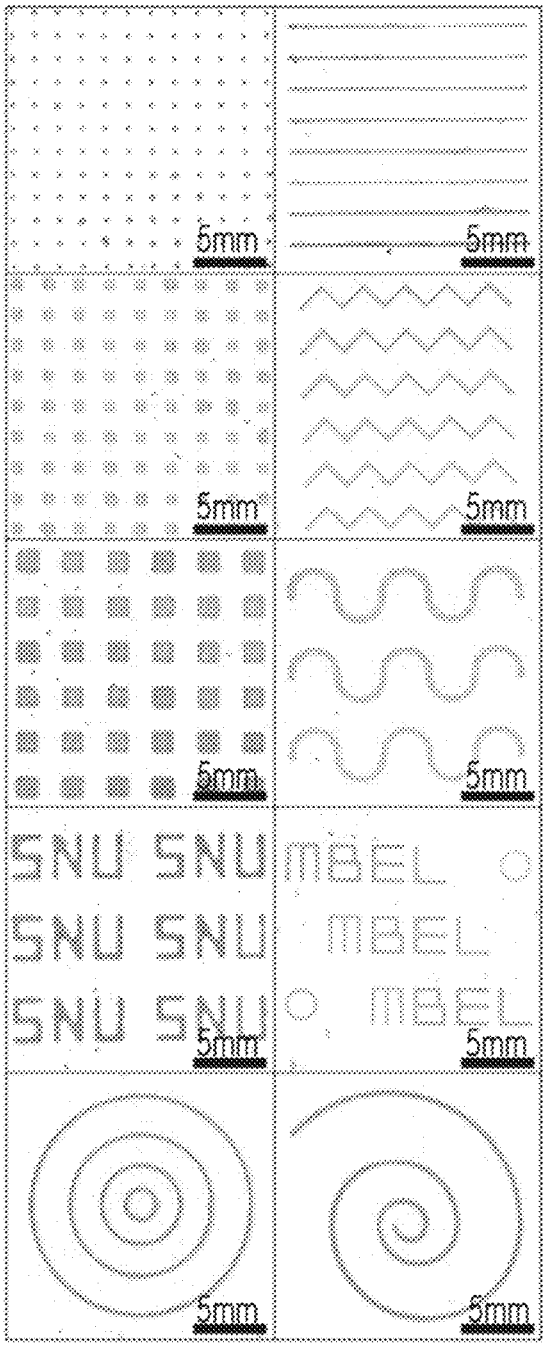
FIG. 10 shows a photograph of results of patterning a liquid with various patterns and sizes by using a liquid patterning device according to an exemplary embodiment of the present invention.

$U_{max}$@100 um=0.8367 m/s
$U_{max}$@200 um=0.5916 m/s
$U_{max}$@300 um=0.4830 m/s
$U_{max}$@400 um=0.4183 m/s
$U_{max}$@500 um=0.3742 m/s
$U_{max}$@600 um=0.3416 m/s
$U_{max}$@700 um=0.3162 m/s
$U_{max}$@800 um=0.2958 m/s
$U_{max}$@900 um=0.2789 m/s Referring to FIGS. 8, 9 and FIG. 10, a non-channel-type liquid patterning device according to the present invention is faster and simpler than the existing channel-type liquid patterning device and has no limits in the pattern shapes and sizes.

Figure 11:
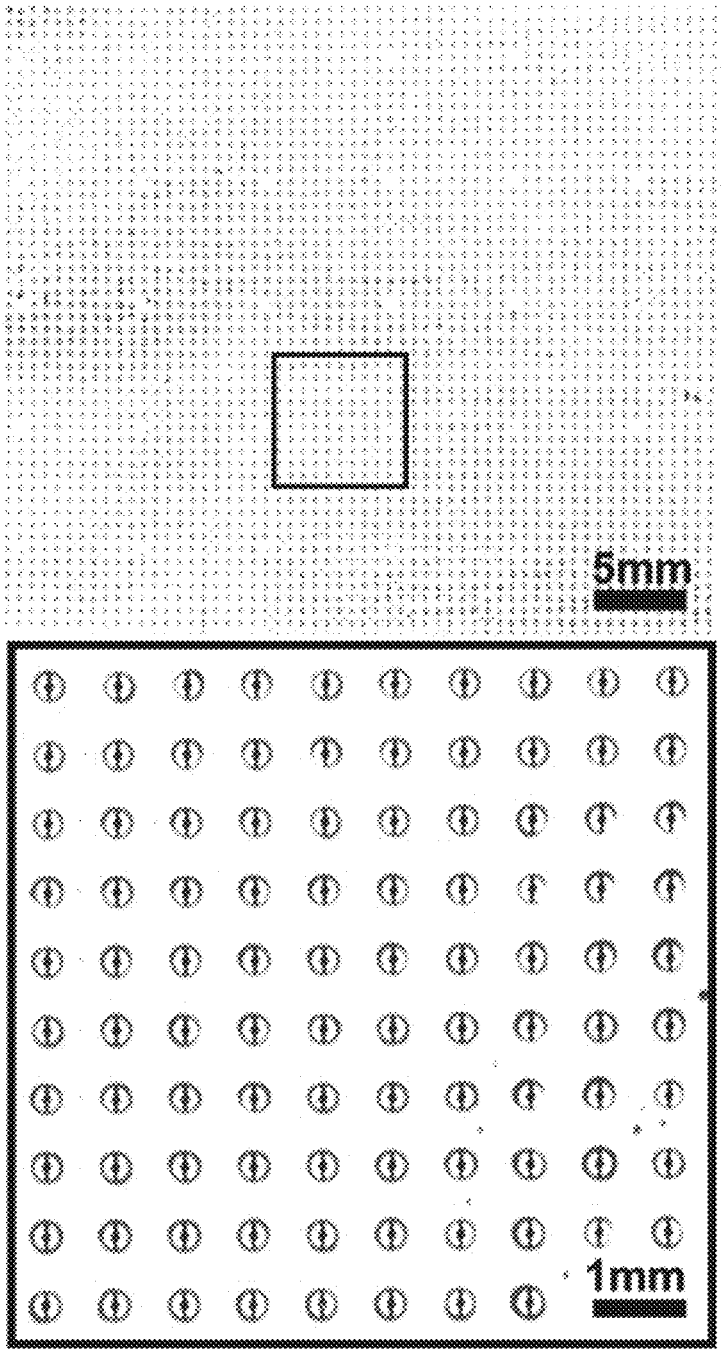
FIG. 11 shows a liquid pattern formed on a surface of a substrate by using a liquid patterning device according to an exemplary embodiment of the present invention.

FIG. 11 shows a photograph for indicating 8,000 liquid patterns formed on the surface of a 50 mm×50 mm substrate.

Figure 12:
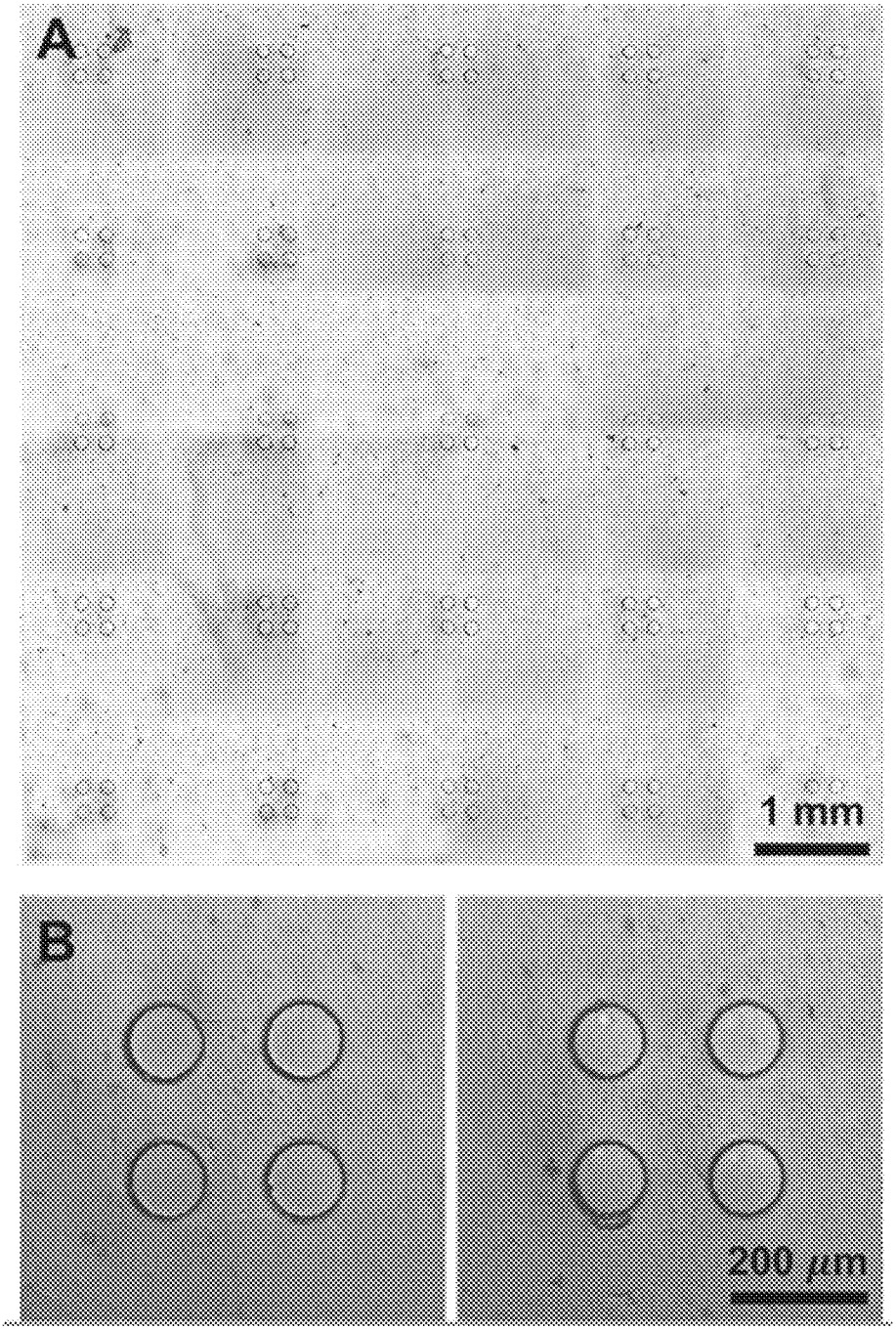
FIG. 12 shows photographs of mixtures of cells and a hydrogel patterned among a plurality of microstructures when liquid is patterned by use of a liquid patterning device according to an exemplary embodiment of the present invention.

FIG. 12 shows a photograph for indicating a mixture of a hydrogel and microalgae patterned between the unit microposts.

As shown in FIG. 12, it is found that a very small amount of cells or liquid may be patterned at the desired position by using the liquid patterning device according to the present invention (it needs a very small amount of cells and liquid compared to the ROI fix method or the existing petri dish method).

Figure 13:
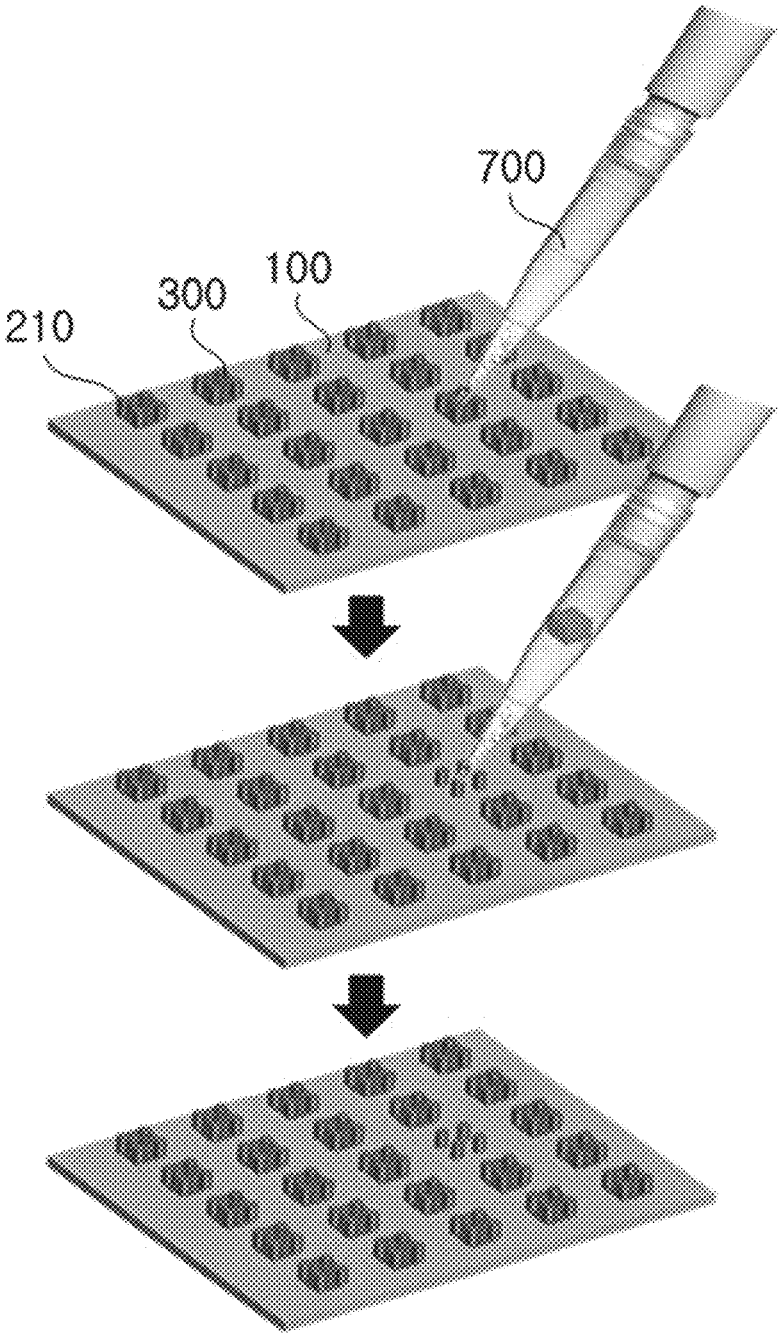
FIG. 13 shows a material recovering state in a microstructure after liquid patterning by use of a liquid patterning device according to an exemplary embodiment of the present invention.
Figure 14:
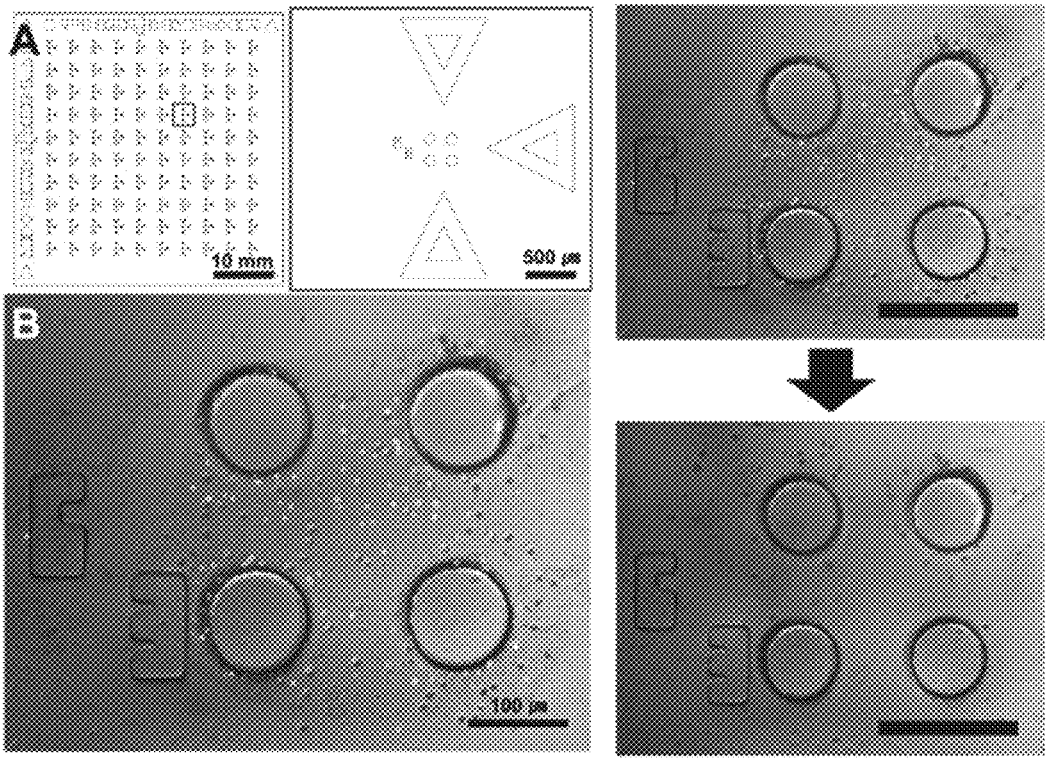
FIG. 14 shows a state for checking coordinates of a cell or a material at a specific position after liquid patterning by use of a liquid patterning device according to an exemplary embodiment of the present invention.

Referring to FIG. 13 and FIG. 14, the liquid patterning device is operable on the surface of the substrate of which the top portion is opened, so it may recover the material, which is impossible by the existing patterning method in the microchannel.

After the liquid patterning through wiping, the user may watch through a microscope, check coordinates of cells or materials at a specific position showing a desired result, view with his eyes, and recover the cells or the material patterned on the position on the coordinates by use of a pipette 700.

Figure 15:
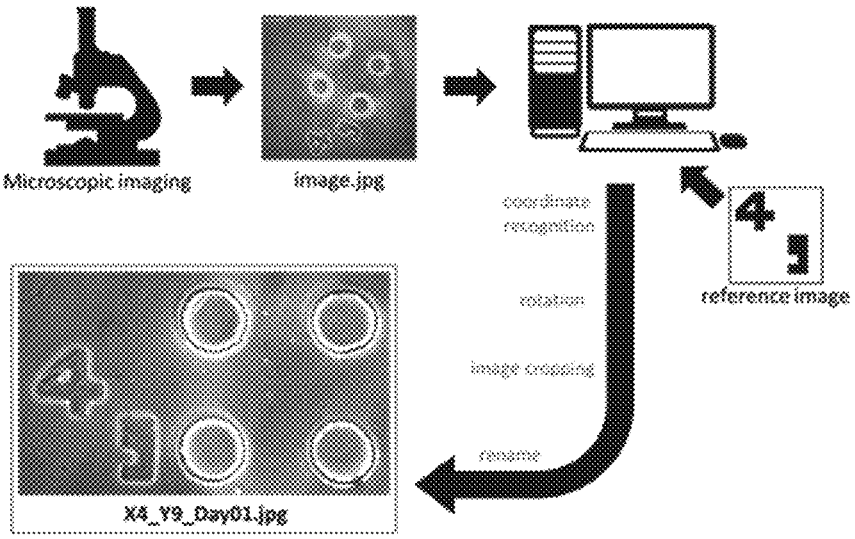
FIG. 15 shows a schematic view of an experiment using a computer to which a liquid patterning device according to an exemplary embodiment of the present invention is applicable and a result analysis system.
Figure 16:
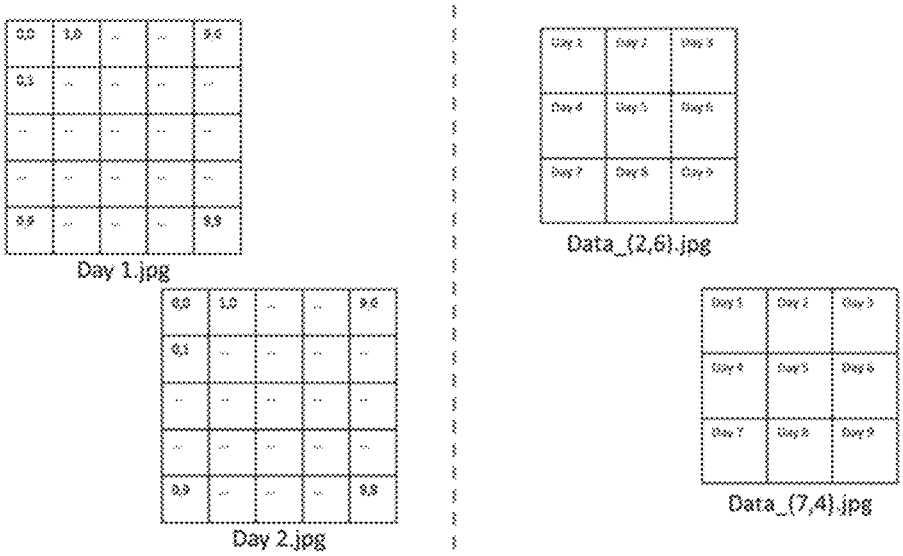
FIG. 16 shows a method for displaying position information (or coordinates) of a microstructure of a liquid patterning device according to an exemplary embodiment of the present invention.

Further, as shown in FIG. 15 and FIG. 16, the inconvenience of displaying unique position information (e.g., coordinates) of each microstructure and finding a specific position for each experiment may be avoided, the accurate position may be checked without additional monitoring (motorized stage) through pattern recognition using a computer, and the embodiment may be used for developing a system that automatically performs editing of, for example, size, brightness, or rotation of images. In addition, image editing for analyzing experimental results may be automatically performed.

Figure 17:
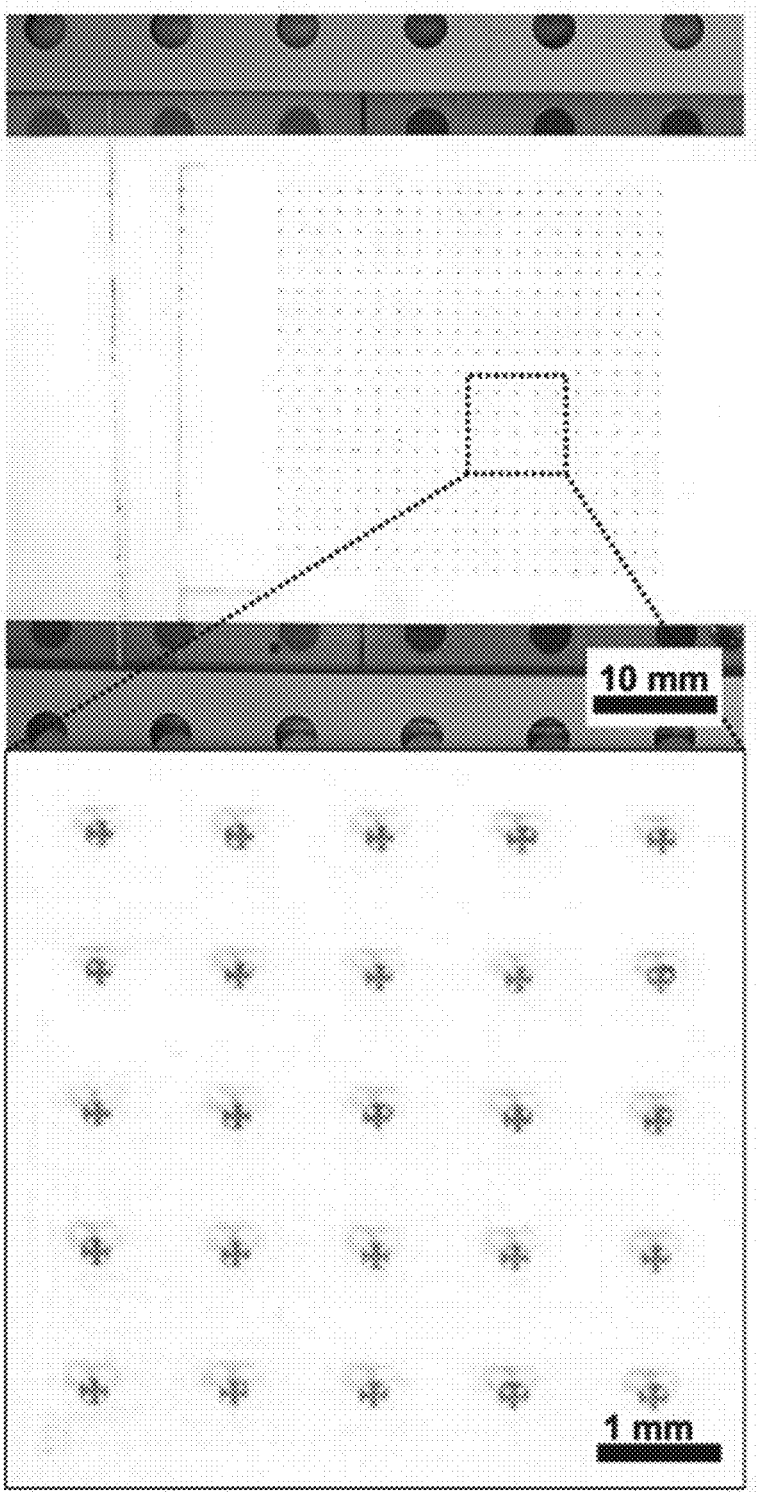
FIG. 17 shows a patterning state by using a liquid patterning device according to an exemplary embodiment of the present invention.
Figure 18:
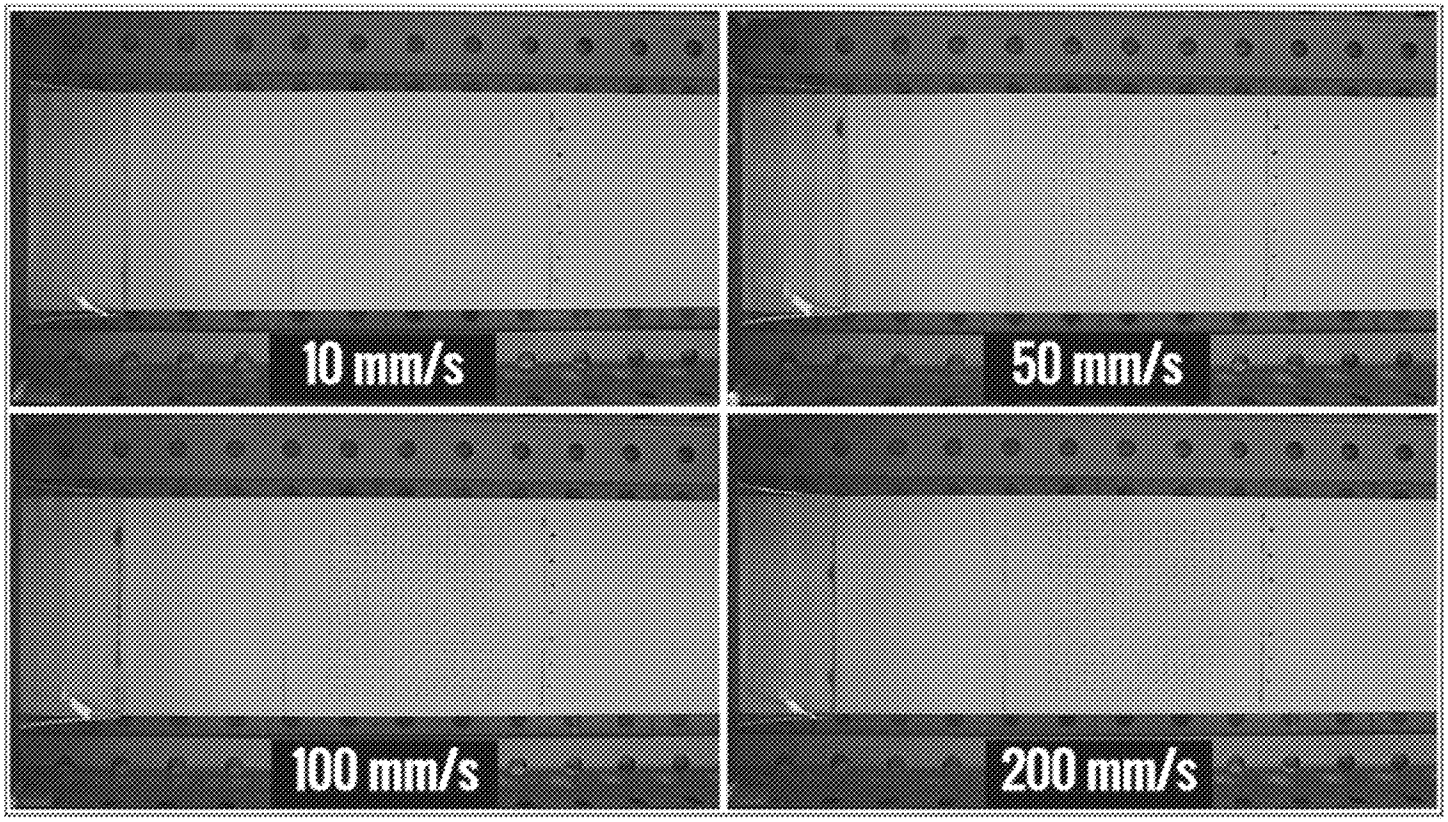
FIG. 18 shows an experimental result for respective wiping speeds of a liquid patterning device according to an exemplary embodiment of the present invention.
Figure 19:
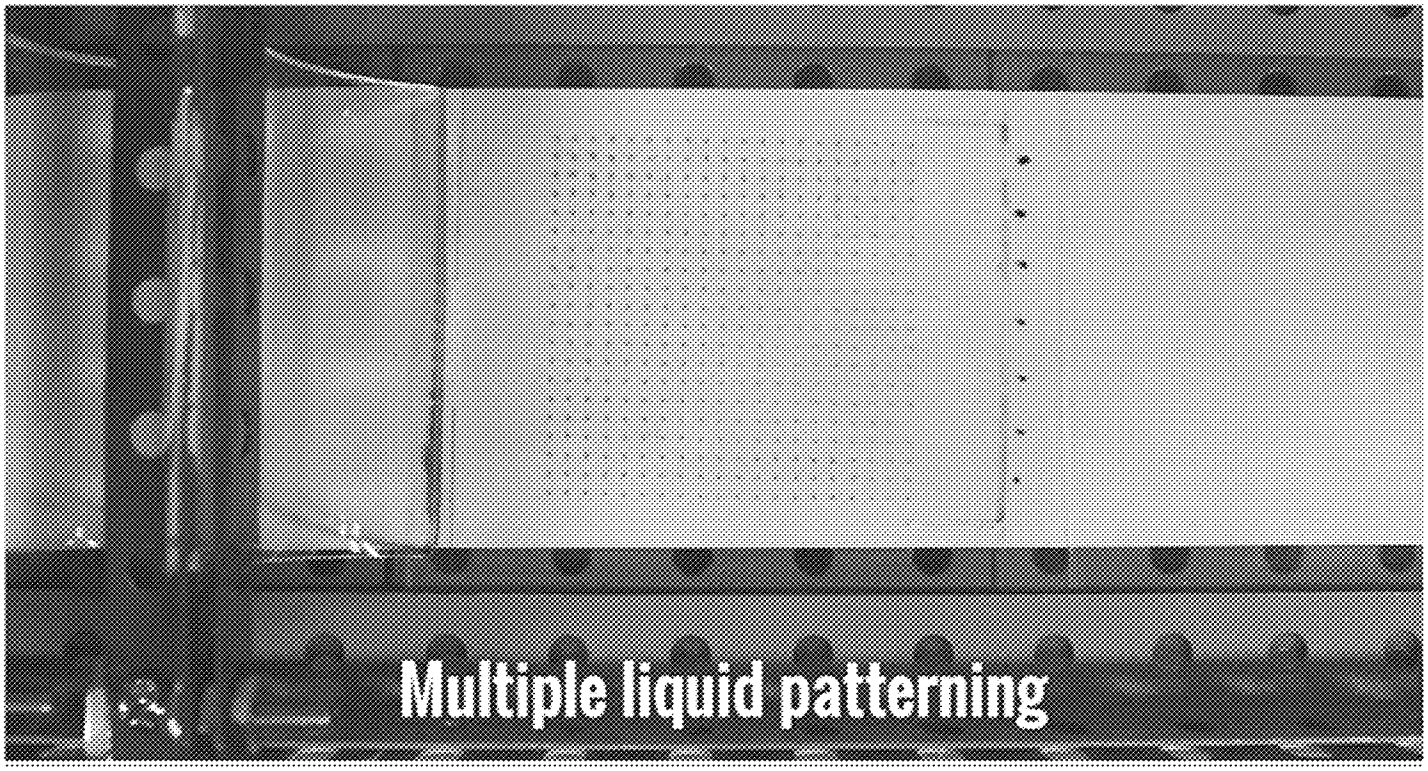
FIG. 19 shows a state for simultaneously generating a plurality of liquid patterns by using a plurality of nozzles by a liquid patterning device according to an exemplary embodiment of the present invention.

FIG. 17 shows a patterning state by using a liquid patterning device according to an exemplary embodiment of the present invention, FIG. 18 shows an experimental result for respective wiping speeds of a liquid patterning device according to an exemplary embodiment of the present invention, and FIG. 19 shows a state for simultaneously generating a plurality of liquid patterns by using a plurality of nozzles by a liquid patterning device according to an exemplary embodiment of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid patterning method for patterning a liquid in a microstructure of a device including a substrate having a flat bottom and a surface, and at least one microstructure formed to vertically protrude from the surface of the substrate and including a plurality of unit microposts so as to have a desired shape, comprising moving a liquid in another direction from one direction of the substrate, using a surface tension between a liquid and a microstructure generated on a top portion and a side portion of the microstructure, and patterning a liquid into the microstructure.

2. The liquid patterning method of claim 1, wherein a top portion of the substrate is opened.

3. He liquid patterning method of claim 1, wherein the unit micropost is made of a hydrophilic material or a hydrophobic material.

4. The liquid patterning method of claim 1, wherein a top portion of the microstructure is opened.

5. The liquid patterning method of claim 1, wherein the moving of the liquid is by wiping the liquid on the surface of the substrate over a unit micropost of the microstructure by using a liquid mover.

6. The liquid patterning method of claim 5, wherein the liquid is filled from the top of the microstructure and at the same time is filled from between the unit microposts into the microstructure along a moving direction of the liquid mover.

7. The liquid patterning method of claim 5, wherein a surface of the liquid mover is made of a hydrophilic material or a hydrophobic material.

8. The liquid patterning method of claim 5, wherein the liquid mover is made of a flexible material that may not damage the unit micropost when the liquid mover contacts the unit micropost protruding on the surface of the substrate.

9. The liquid patterning method of claim 5, wherein the liquid mover is made of a material with a contact angle of 0° to 175° between the liquid mover and the liquid to be patterned.

10. The liquid patterning method of claim 5, wherein the contact angle between the liquid mover and the liquid is larger than the contact angle between the microstructure and the liquid and the contact angle between the substrate and the liquid.

11. The liquid patterning method of claim 5, wherein when the liquid to be patterned is wiped with the liquid mover, an angle between the liquid mover and the surface of the substrate is between 0° and 90°.

12. The liquid patterning method of claim 5, wherein the liquid is patterned while the liquid mover moves, or the liquid is patterned when the liquid mover is fixed and the substrate including a microstructure moves.

13. The liquid patterning method of claim 1, further comprising spraying the liquid on a surface of the substrate by a plurality of nozzles provided on a top portion of the microstructure before moving the liquid.

14. The liquid patterning method of claim 13, wherein the liquid is sprayed nearby the microstructure from the plurality of nozzles, and then the liquid is filled in the microstructure by the moving.

15. The liquid patterning method of claim 1, wherein the substrate is made of a hydrophilic material or a hydrophobic material.

16. The liquid patterning method of claim 15, wherein the substrate is made of a material with a contact angle of 0° to 170° between the surface and the liquid to be patterned.

17. The liquid patterning method of claim 1, wherein the unit micropost is generated to have at least one of shapes including a circular cylinder, a square pillar, a cone, and a curve.

18. The liquid patterning method of claim 1, wherein the device includes at least two of the microstructures.

19. The liquid patterning method of claim 18, wherein a gap between the microstructures is 0.1 μm or more, and is less than twice the height of the unit micropost.

20. The liquid patterning method of claim 1, further comprising, removing by suctioning a liquid that has not been patterned into the microstructure.

* * * * *